US005802883A

United States Patent [19]

Matsuda et al.

[11] Patent Number: 5,802,883

[45] Date of Patent: Sep. 8, 1998

[54] KNIT SLIDE FASTENER STRINGER

[75] Inventors: Yoshio Matsuda; Hidenobu Kato; Yoshito Ikeguchi, all of Toyama-ken, Japan

[73] Assignee: YKK Corporation, Tokyo, Japan

[21] Appl. No.: 879,817

[22] Filed: Jun. 20, 1997

[30] Foreign Application Priority Data

Jun. 24, 1996 [JP] Japan ..... 8-163380

[51] Int. Cl.[6] ..... D04B 21/20; D04B 21/14; A44B 19/56

[52] U.S. Cl. ..... 66/193; 66/192; 24/392

[58] Field of Search ..... 66/192, 193, 190; 24/392

[56] References Cited

U.S. PATENT DOCUMENTS

| | | | |
|---|---|---|---|
| 5,035,125 | 7/1991 | Frohlich et al. | 66/193 |
| 5,502,985 | 4/1996 | Matsuda et al. | 66/193 |
| 5,502,986 | 4/1996 | Matsuda et al. | 66/192 X |
| 5,522,240 | 6/1996 | Wall et al. | 66/192 |
| 5,540,064 | 7/1996 | Matsuda et al. | 66/193 |
| 5,615,563 | 4/1997 | Matsuda et al. | 66/192 X |
| 5,685,177 | 11/1997 | Matsuda et al. | 66/193 |
| 5,706,677 | 1/1998 | Matsuda | 66/192 |

FOREIGN PATENT DOCUMENTS

| | | |
|---|---|---|
| 0 743 025 A2 | 11/1996 | European Pat. Off. . |
| 38-11673 | 7/1938 | Japan . |
| 2-255104 | 2/1990 | Japan . |

*Primary Examiner*—John J. Calvert
*Attorney, Agent, or Firm*—Hill & Simpson

[57] ABSTRACT

A knit slide fastener stringer including a fastener tape knitted in a warp-knit ground structure and having along one longitudinal edge an element-attaching portion, and a continuous fastener element row knitted in and along the element-attaching portion of the fastener tape and secured by two or more wales of anchoring chain stitch yarns simultaneously with the knitting of the fastener tape. In this knit slide fastener stringer, successive needle loops of each of the two or more wales formed of the anchoring chain stitch yarns press the continuous fastener element row toward the warp-knit structure of said fastener tape from the upper side, and successive sinker loops constitute part of the ground structure. And a number of warp-inlaid yarns are each laid in and interlaced with at least part of the successive sinker loops. The result is that the ground structure of the element-attaching marginal portion is kept in accurate size to prevent the coupled fastener element rows from locally splitting.

4 Claims, 10 Drawing Sheets

KNIT SLIDE FASTENER STRINGER

BACKGROUND OF THE INVENTION

1. Field of the Invention

This invention relates to a knit slide fastener stringer having a warp-knit fastener tape and a continuous fastener element row which is knitted in and along a longitudinal edge of the fastener tape simultaneously with the knitting of the fastener tape. More particularly the invention relates to a knit slide fastener stringer in which a continuous fastener element row is attached to one longitudinal edge of a warp-knit fastener tape stably without either causing irregularity in pitch or locally splitting from the fastener element row.

2. Description of the Related Art

A conventional knit slide fastener stringer of the type in which a continuous fastener element row is knitted in a fastener tape simultaneously with the knitting of the fastener tape is disclosed in, for example, Japanese Patent Publication No. Sho 38-11673 and Japanese Patent Laid-Open Publication No. Hei 2-255104. In either of these knit slide fastener stringers, a continuous fastener element row of a synthetic resin monofilement is attached to one longitudinal margin of a fastener tape, which has a warp-knit ground structure, by knitting the continuous fastener element row with stitches of a plurality of anchoring chain stitch yarns at the longitudinal tape margin to secure the element row, simultaneously with the knitting of the fastener tape. However, in the former knit slide fastener stringer, partly since each element of the continuous fastener element row is secured to the longitudinal margin of the fastener tape only by a single sinker loop of respective anchoring chain stitch yarn, and partly because of the natural stretchability of chain stitches, only a limited degree of securing force can be obtained. In the latter knit slide fastener stringer, since the sinker loops or the needle loops of the anchoring chain stitch yarns extend over the leg portions of the successive fastener elements, the ground structure of the element-attaching marginal tape portion becomes thin so that local split tends to occur at a coupled portion of a pair of coupled fastener element rows as it is raised when an upward bending stress acts on the slide fastener surface.

A knit slide fastener stringer developed in an effort to eliminate the foregoing problems is disclosed in, for example, Japanese Patent Laid-Open Publication No. Hei 8-314. According to this knit slide fastener stringer, in needle loops forming a single wale of the ground structure of a fastener tape by element-row-anchoring chain stitch yarns, another chain stitch yarn is additionally knitted in an effort to make the ground structure dense so that the fastener element row can be secured to the ground structure with increased stability.

However, even in the knit slide fastener stringer of Japanese Patent laid-Open Publication No. Hei 8-314, since knitting yarns to press the fastener element row downwardly on the side remote from the ground structure are yet only sinker loops of the anchoring chain stitch yarns, the knit structure to be disposed over and under the fastener element row become unbalanced and the one over the fastener element row would be still inadequately tough so that the coupled fastener element rows would tend to split locally when an upward bending stress acts on the slide fastener surface. Further, in order to stabilize the anchoring chain stitches themselves, an additional chain stitch yarn is knitted in the ground structure as disclosed in the publication, which means that total three knitting yarns including a tricot stitch yarn are interlaced, thus it is technologically complex and hence is difficult to form stitches.

SUMMARY OF THE INVENTION

It is therefore an object of this invention to provide a knit slide fastener stringer in which a fastener element row can be knitted easily and secured to a warp-knit fastener tape firmly in a stable size by a unique warp-knit structure and has an adequate degree of resistance against an upward thrust acting on the slide fastener surface so that no local split would tend to occur between coupled fastener element rows even when the slide fastener is bent while using.

According to this invention, the above object is accomplished by a knit slide fastener stringer comprising: a fastener tape knitted in a warp-knit ground structure and having along one longitudinal edge an element-attaching portion; and a continuous fastener element row knitted in and along the element-attaching portion of the fastener tape and secured by two or more wales of anchoring chain stitch yarns simultaneously with the knitting of the fastener tape; successive needle loops of each of the two or more wales formed of the anchoring chain stitch yarns press the continuous fastener element row toward the warp-knit ground structure of the fastener tape from the upper the, and successive sinker loops constitute part of the ground structure; and that a number of warp-inlaid yarns are each laid in and interlaced with at least part of the successive sinker loops.

Preferably, each of the warp-inlaid yarns is laid in and interlaced with the sinker loops along each of the wales in a zigzag pattern, or a plurality of the warp-inlaid yarns are inlaid in and interlaced with the sinker loops along each of the wales individually in a zigzag pattern and collectively in a symmetrical pattern.

Alternatively, a plurality of the warp-inlaid yarns nay be laid in and interlaced with the sinker loops of two or more of the wales individually in a zigzag pattern and collectively in a symmetrical pattern, extending across one another between the wales.

With the foregoing arrangement, the warp-knit ground structure of the element-attaching marginal portion of the tape approximates to a woven structure, has a touch of woven cloth and is very stable in size. Because of this size-stable element-attaching marginal tape portion, the fastener element row can be attached to the ground structure of the marginal portion at that region in precise pitch. Since the leg portions of the fastener element row are pressed from the upper side by needle loops, it is possible to facilitate balancing the knitting yarns disposed over and under the leg portions and to give an adequate degree of resistance against an upward bending stress acting on the slide fastener surface, thus preventing the coupled fastener element rows from locally splitting as being raised while the slide fastener is used under any conditions. As a result, the slide fastener can perform its closing function sufficiently.

Further, since the knit slide fastener stringer of this invention can be manufactured only by adding warp-inlaid yarns laid in and interlaced with sinker loops of the chain stitch yarns on the ground structure side of the element-attaching marginal portion where the continuous fastener element row is mounted, it is possible to knit the slide fastener stringer smoothly with no overload on the knitting needles. Also since this slide fastener stringer can be knitted on a single row of needle beds, it requires only a simple knitting mechanism so that complexity in operation and designing can be avoided.

DETAILED DESCRIPTION OF THE PRESENT EMBODIMENTS

Figure 1:
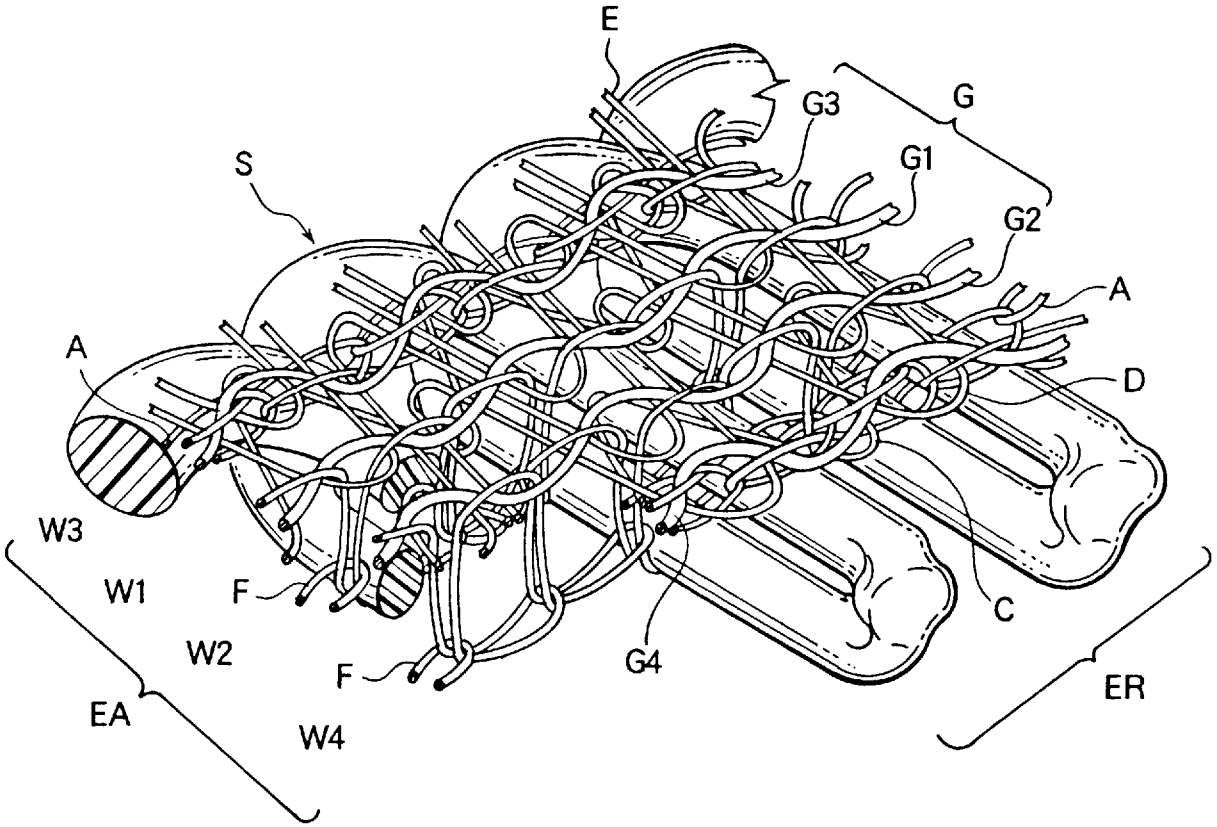
FIG. 1 is a fragmentary rear perspective view schematically showing an element-attaching marginal portion of a knit slide fastener stringer according to a first embodiment of this invention.
Figure 2:
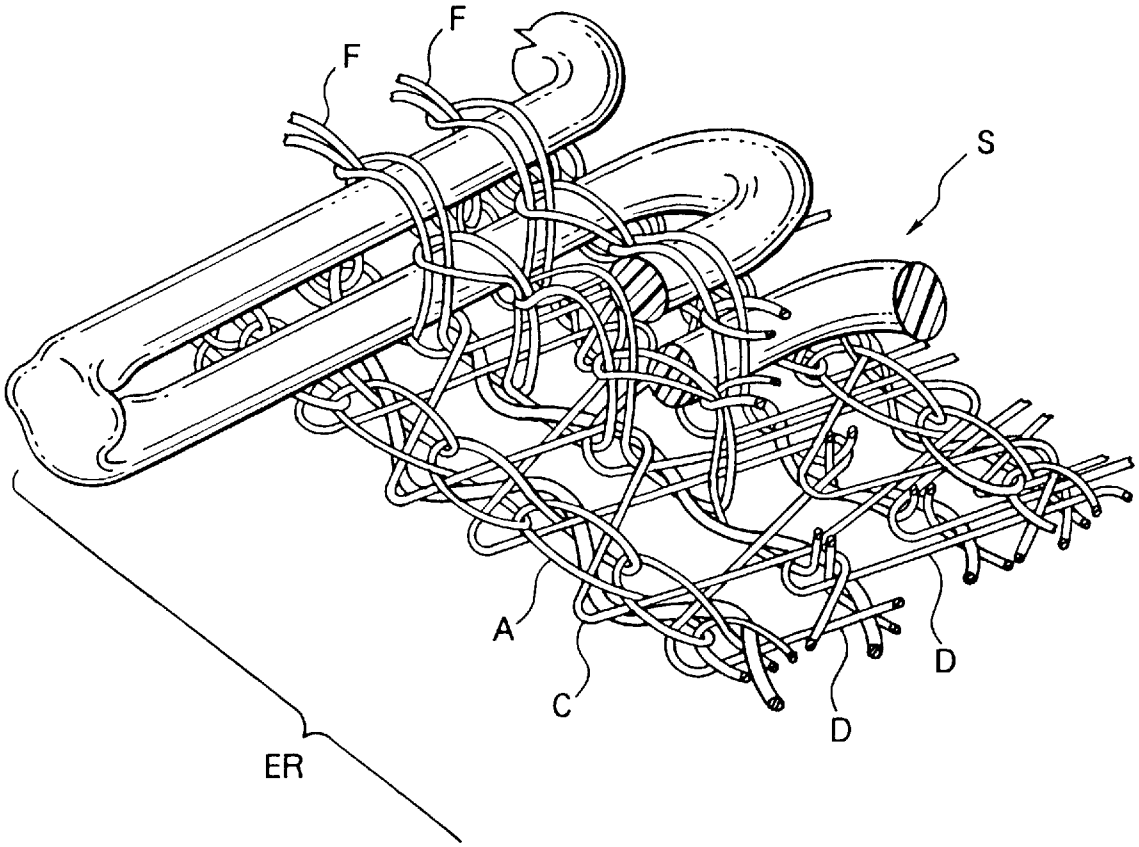
FIG. 2 is a fragmentary front perspective view of the element-attaching marginal portion of the first embodiment.
Figure 3:
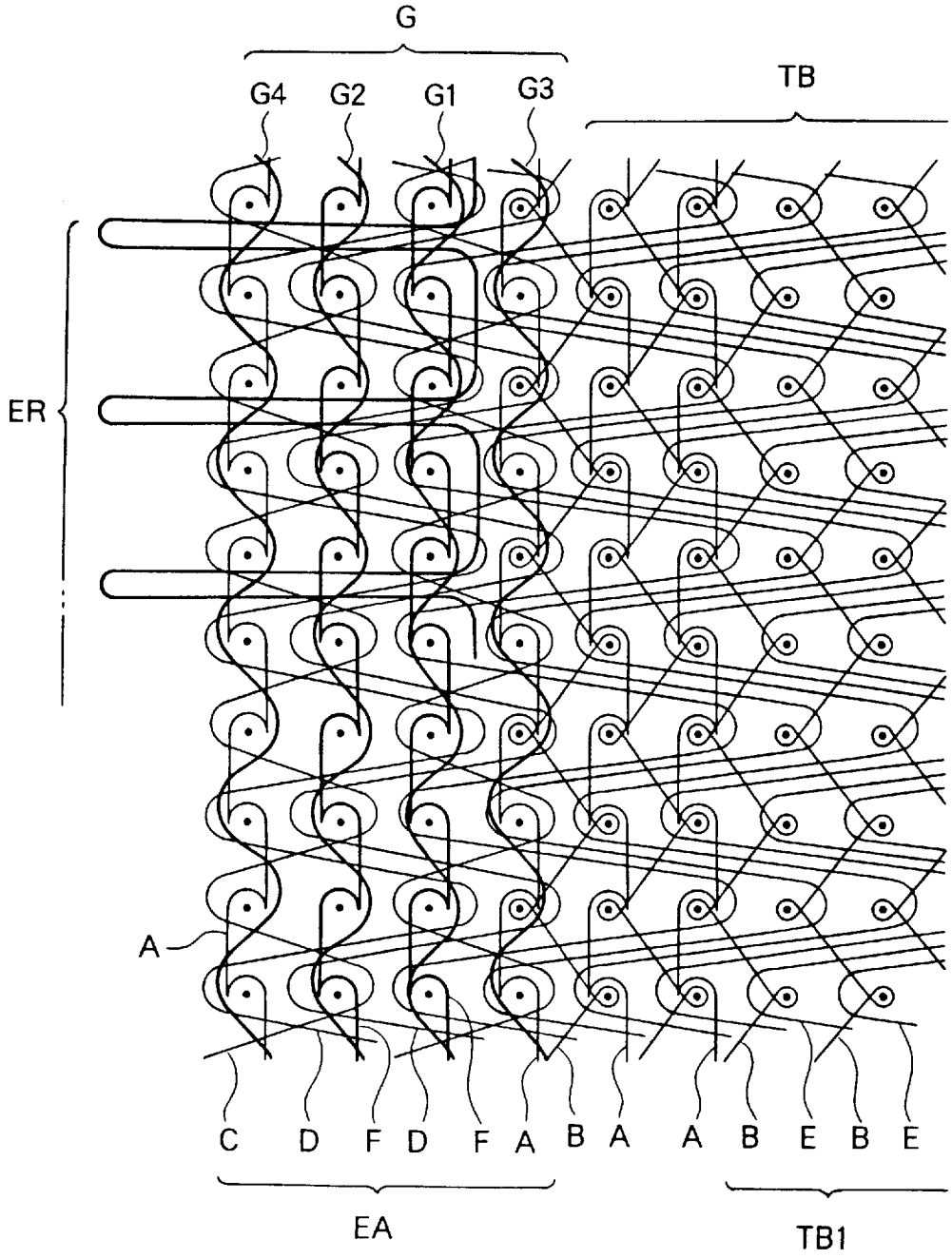
FIG. 3 is a warp-knitting diagram showing the warp-knit structure of the knit slide fastener stringer of the first embodiment.
Figure 4:
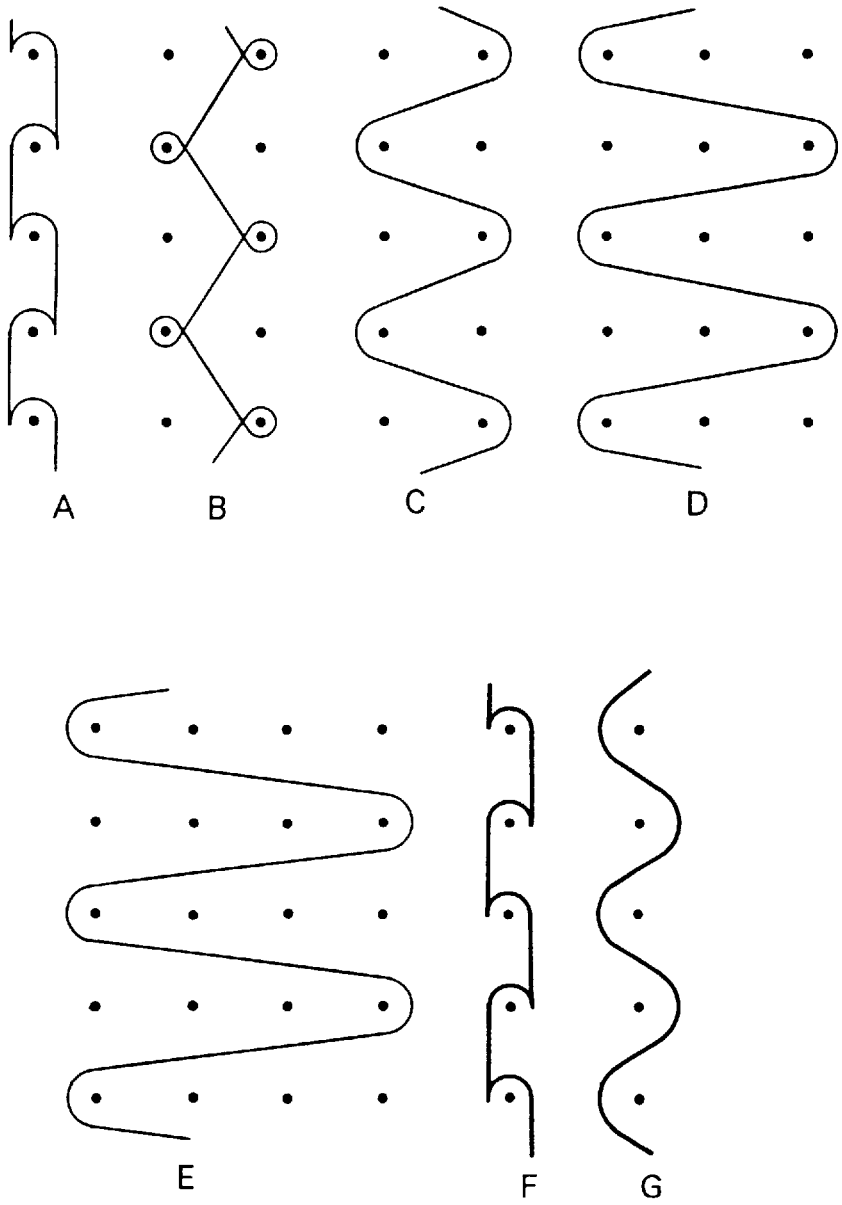
FIG. 4 is a warp-knitting diagram showing individual knitting yarns of the knit slide fastener stringer of the first embodiment.

Various preferred embodiments of this invention will now be described in detail with reference to the accompanying drawings. FIGS. 1 through 4 show a first embodiment of this invention; specifically, FIG. 1 is a fragmentary rear perspective view of a knit slide fastener stringer, schematically showing the manner in which a continuous fastener element row is attached to an element-attaching portion of a warp-knit fastener tape, FIG. 2 is a fragmentary front perspective view of the knit slide fastener stringer, FIG. 3 is a warp-knitting diagram showing the warp-knit structure of the knit slide fastener stringer, and FIG. 4 is a warp-knitting diagram showing individual knitting yarns of the knit slide fastener stringer.

Though in FIGS. 1 and 2 the individual knitting yarns mainly of the element-attaching portion of the fastener tape are shown in slackened state with a web portion of the fastener tape omitted, actually the individual knitting yarns have dense stitches and are tightly interlaced with one another. Also, though the individual knitting yarns are shown differently in size for better understanding, the size of the individual knitting yarn may be selected as desired to meet the requirements for the knit slide fastener stringer. The same can be said for other embodiments described below and shown in FIGS. 5 through 10.

As is understood from FIGS. 1 through 4, the knit slide fastener stringer S of the first embodiment may be knitted on an ordinary warp-knitting machine equipped with a single row of needle beds; the same can be said for other embodiments and modifications described below.

In the first embodiment, as shown in FIGS. 3 and 4, the ground structure of the web portion TB of the fastener tape is composed of chain stitch yarns A knitted in a pattern of 0-1/1-0, tricot stitch yarns B knitted in a pattern of 1-0/1-2, and three kinds of weft-inlaid yarns C, D, E laid in the fastener tape weftwise in a pattern of 0-0/2-2, a pattern of 3-3/0-0 and a pattern of 4-4/0-0, respectively, each extending in a zigzag pattern. According to this embodiment, as shown in FIG. 3, in a central region TB1 of the web portion TB, the chain stitch yarns A are omitted in order to give the central region TB1 some degree of softness so as to fit to a garment, etc., thus realizing easy and precise attachment of the slide fastener stringer S. Alternatively, the chain stitch yarns A may be knitted in the central region TB1 of the web portion TB like the remaining region.

In this embodiment, four wales of the fastener tape T from its longitudinal edge constitute an element-attaching marginal portion EA in and along which a coiled synthetic resin monofilament is to be knitted, taking a return trip weftwise in every other courses to form a continuous fastener element row ER. Simultaneously with this forming, the fastener element row ER is knitted in and secured to the element-attaching marginal portion EA along every other courses by two wales of anchoring chain stitch yarns F knitted in a common pattern of 0-1/1-0. Each of the anchoring chain stitch yarns F, as shown in FIGS. 1 and 2, has longitudinally knitted needle loops extending over leg portions of the individual fastener elements E of the fastener element row ER, so that the fastener element row ER is pressed from the upper side against the ground structure of the marginal portion EA by the needle loops successive in wale direction, thus securing the fastener element row ER to the element-attaching marginal portion EA. In the meantime, successive sinker loops of each of the anchoring chain stitch yarns F extend under the individual leg portions of the fastener element row ER to form groups of sinker loops each extending in the wale direction, so as to constitute part of the ground structure of the element-attaching marginal portion EA.

In this embodiment, a warp-inlaid yarn G1 is laid in the ground structure of the element-attaching marginal portion EA in a knitting pattern of 1-0/0-1 and is interlaced with every successive sinker loops of the anchoring chain stitch yarns F. In the first embodiment, not only two warp-inlaid yarns G1, G2 are laid in the ground structure along two wales W1, W2 of the respective anchoring chain stitch yarns F, but also two additional warp-inlaid yarns G3, G4 are laid in a zigzag pattern in two wales W3, W4, respectively, of the chain stitch yarns A disposed on the inner and outer sides of the wales W1, W2. With this arrangement, it is possible to give the whole ground structure of the element-attaching marginal portion EA a touch and shape of woven cloth so that the fastener element row ER can be secured to the element-attaching marginal portion EA stably without varying in size either warpwise or weftwise. Alternatively, these warp-inlaid yarns G1, G2, G3, G4 may be laid only in the anchoring chain stitch yarns F or may be laid in the respective chain stitch yarns F, F, A forming three wales W1, W2, W4 including the outermost wale of the fastener tape T. Thus this invention should by no means be limited to this illustrated example, and various modifications may be suggested.

Figure 5:
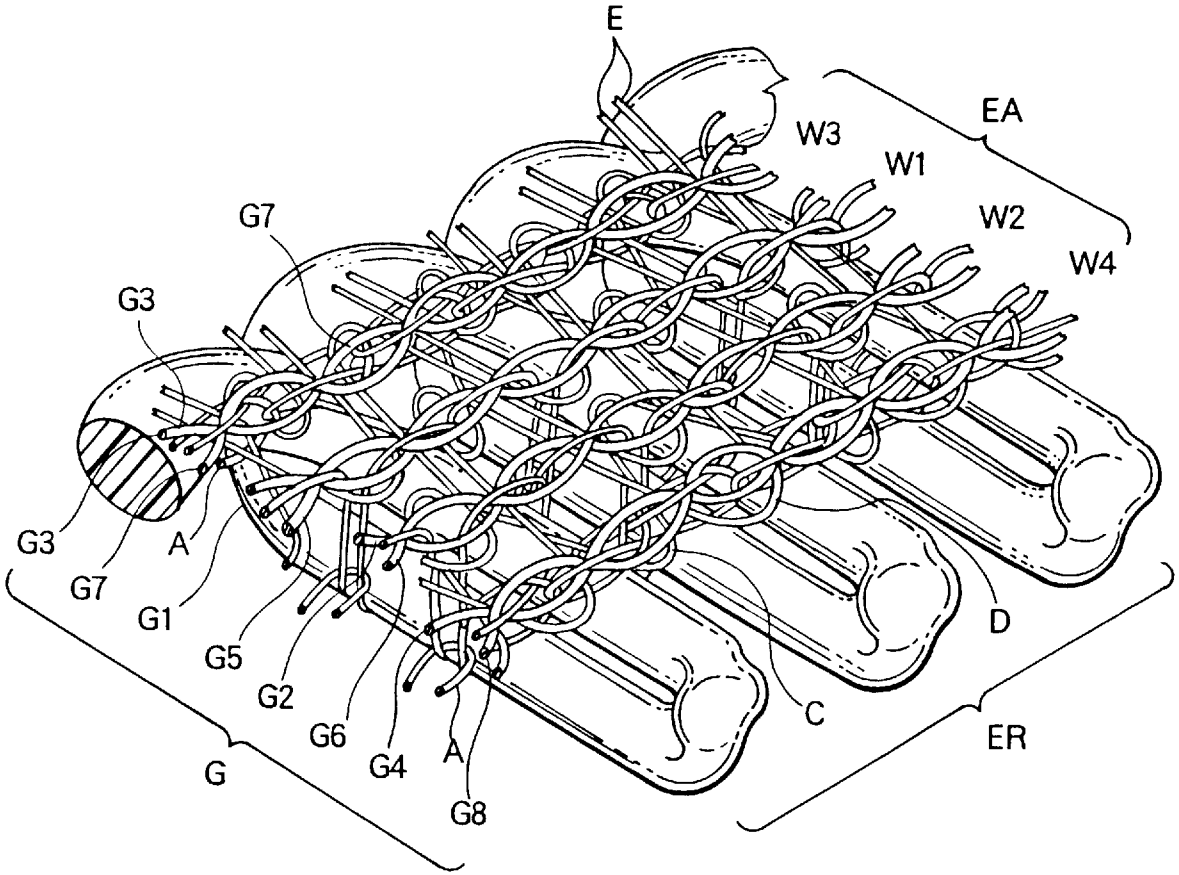
FIG. 5 is a fragmentary rear perspective view schematically showing an element-attaching marginal portion of a knit slide fastener stringer according to a second embodiment of the invention.

FIG. 5 is a fragmentary rear perspective view of a knit slide fastener stringer according to a second embodiment. In this embodiment, the individual knitting yarns except warp-inlaid yarns G1 through G8 are similar in knitting pattern with those of the first embodiment. Namely, two pairs of warp-inlaid yarns G1, G5; G2, G6 are laid in and interlaced with the successive sinker loops of an anchoring chain stitch yarn F each of two wales W1, W2 in such a pattern that each pair is symmetrical, repeatedly crossing each other. In the illustrated embodiment, not only the warp-yarns G1, G5; G2, G6 are laid in two anchoring chain stitches F of the wales W1, W2, but also the warp-inlaid yarns G3, G7; G4, G8 are laid respectively in each of the chain stitches A of the wales W3, W4 which are disposed on the opposite sides of W1, W2 and constitute part of the ground structure. Alternatively, these warp-inlaid yarns G3, G7; G4, G8 are not necessarily laid in the sinker loops of the chain stitch yarn A. The warp-inlaid yarns G1, G5; G2, G6; G4, G8 may be inlaid in the chain stitch structure of the two anchoring chain stitch yarns F, and the warp-knit structure of the outermost chain stitch yarn A and the weft-inlaid yarns C, D, respectively.

Figure 6:
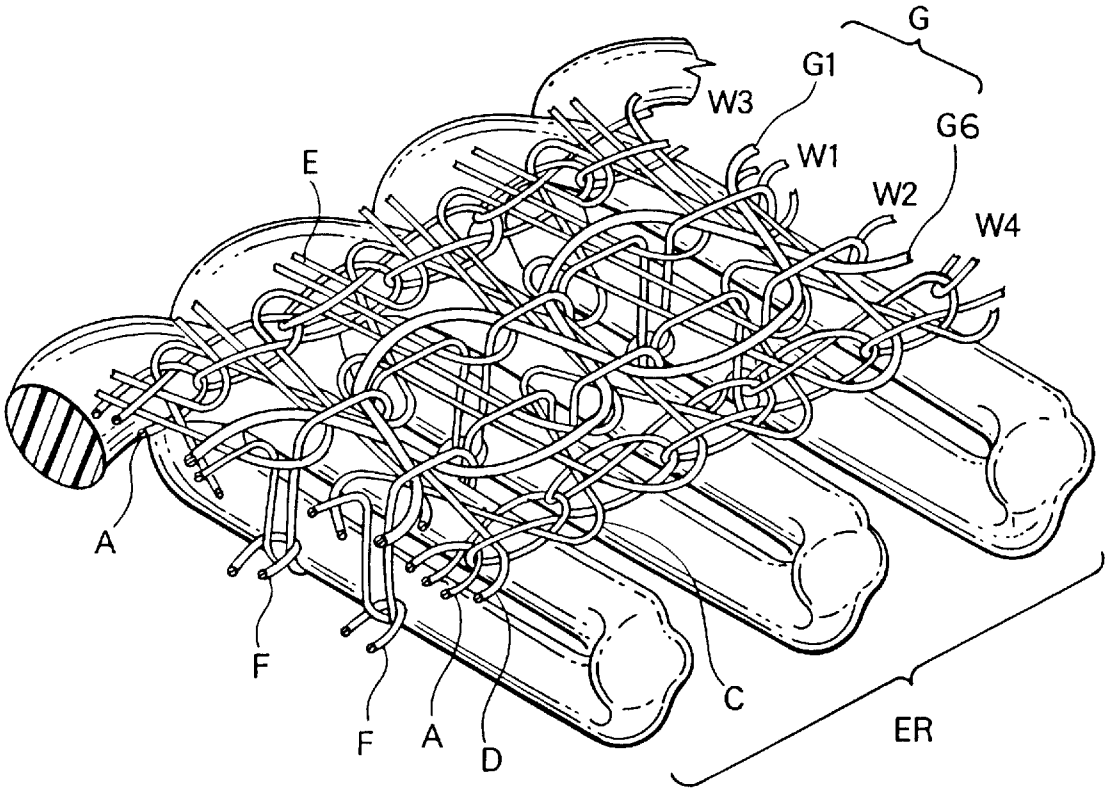
FIG. 6 is a fragmentary rear perspective view schematically showing an element-attaching marginal portion of a knit slide fastener stringer according to a third embodiment.

FIG. 6 is a fragmentary rear perspective view of a knit slide fastener stringer according to a third embodiment. Also in this embodiment, the individual knitting yarns are similar in knitting pattern to those in the first embodiment except the warp-inlaid yarns G1, G6. Namely, two warp-inlaid yarns G1, G6 are inlaid in warpwise and interlaced with every other sinker loops of two rows of sinker loops formed of the anchoring chain stitch yarns F of two wales W1, W2 onto which the coiled fastener element rows ER are fixed individually in a zigzag pattern and collectively in a symmetrical pattern, repeatedly crossing each other between the two wales W1, W2.

Figure 7:
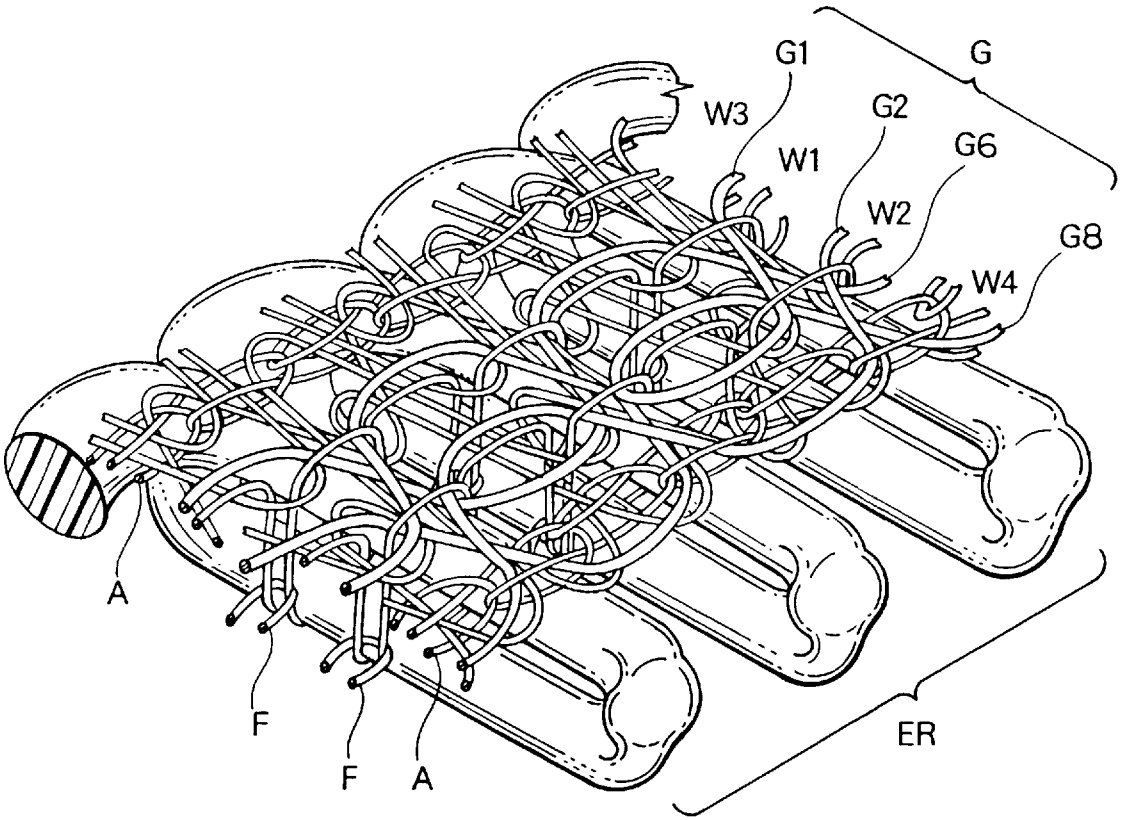
FIG. 7 is a fragmentary rear perspective view schematically showing an element-attaching marginal portion of a knit slide fastener stringer according to a fourth embodiment.

FIG. 7 is a fragmentary perspective view showing a fourth embodiment similar to the third embodiment except that two warp-inlaid yarns G2, G8 are laid in warpwise and interlaced with every other sinker loops of a chain stitch yarn A of the outermost wale W4 and every other sinker loops of an anchoring chain stitch yarn F of the second outermost wale W2 individually in a zigzag pattern and collectively in a symmetrical pattern, repeatedly crossing each other between the two wales W4, W2.

Figure 8:
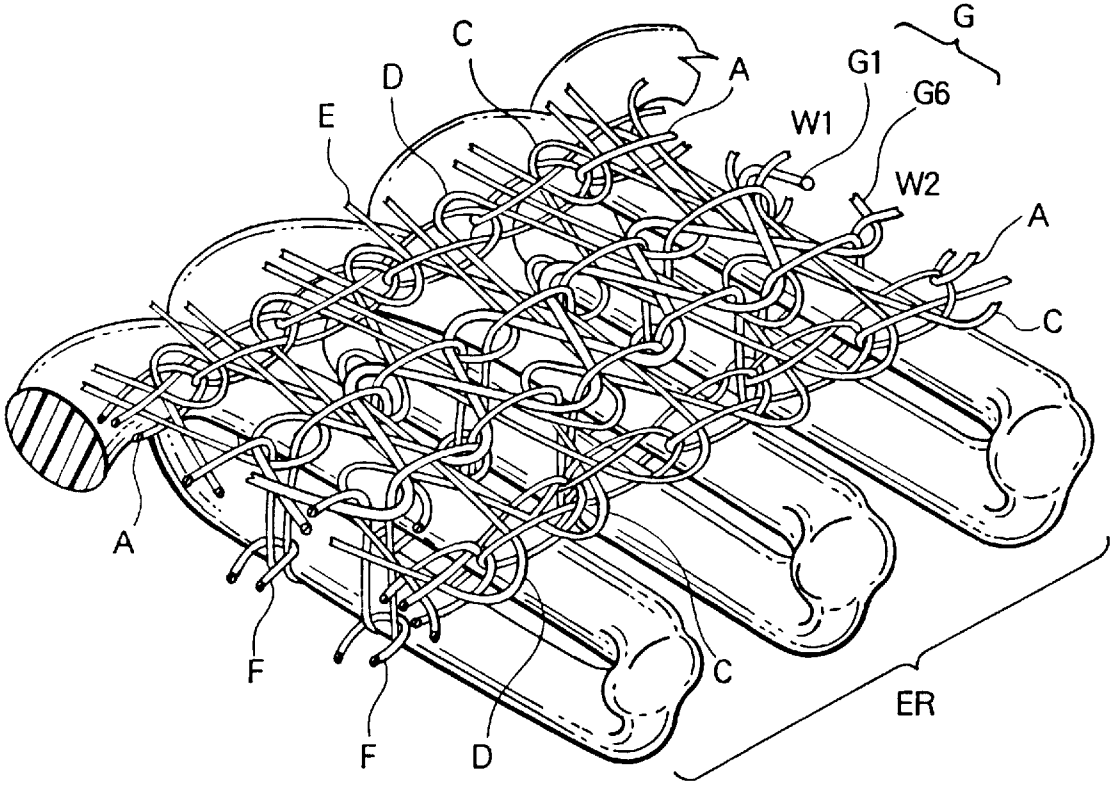
FIG. 8 is a fragmentary rear perspective view schematically showing an element-attaching marginal portion of a knit slide fastener stringer according to a fifth embodiment.

FIG. 8 shows a fifth embodiment in which two warp-inlaid yarns G1, G6 are used like the third embodiment but which are differentiated from the third embodiment in that the two warp-inlaid yarns G1, G6 are laid in and interlaced with the successive sinker loops of a pair of anchoring chain stitch yarns F of two wales W1, W2 warpwise individually in a zigzag pattern and collectively in a symmetrically pattern, repeatedly crossing each other between the two wales W1, W2.

Figure 9:
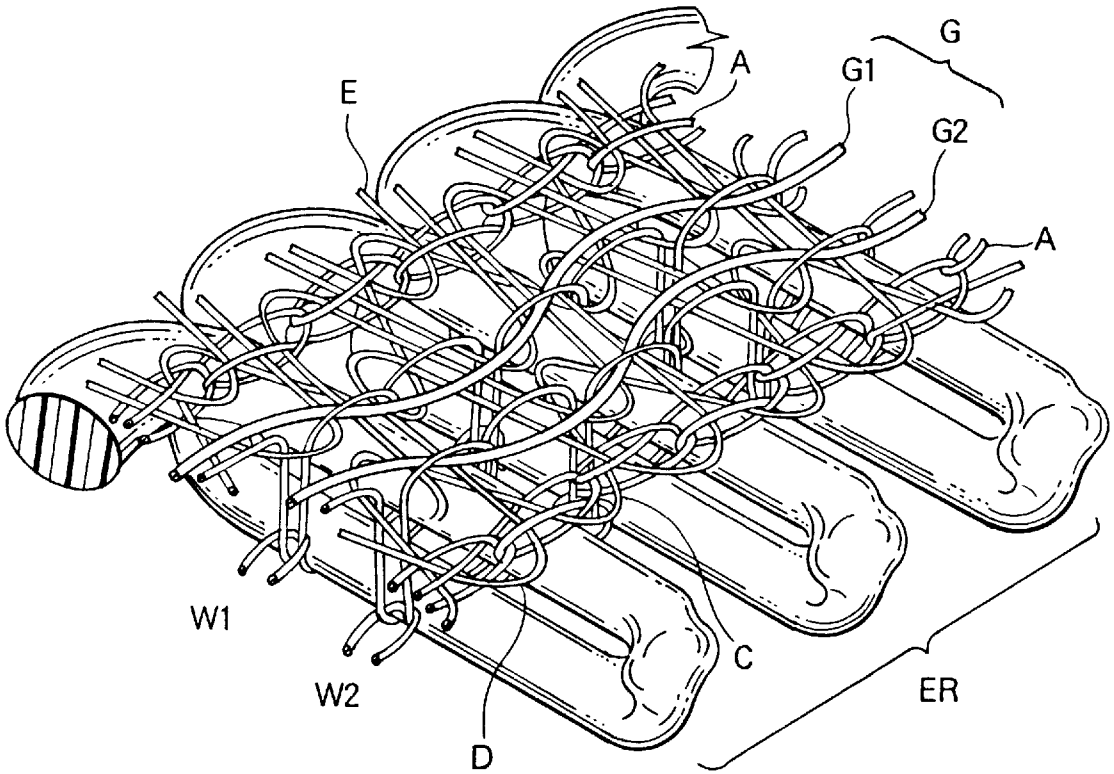
FIG. 9 is a fragmentary rear perspective view schematically showing an element-attaching marginal portion of a knit slide fastener stringer according to a sixth embodiment.

FIG. 9 shows a sixth embodiment in which two warp-inlaid yarns G1, G2 are laid one in the sinker loops of each of two anchoring chain stitch yarns F like the first embodiment but which is differentiated from the first embodiment in that each warp-inlaid yarn G1, G2 is interlaced with every other sinker loops of the corresponding anchoring chain stitch yarn F. In this illustrated example, the two warp-inlaid yarns G are laid in the sinker loops of the anchoring chain stitch yarns F of two wales W1, W2, respectively. Alternatively, warp-inlaid yarns F may be laid in the two chain stitch yarns A, which are disposed at outer and inner sides of the respective anchoring chain stitch yarns F and constitute part of the ground structure, or the warp-inlaid yarn G may be laid in the chain stitch yarn A of the outermost wale W4.

Figure 10:
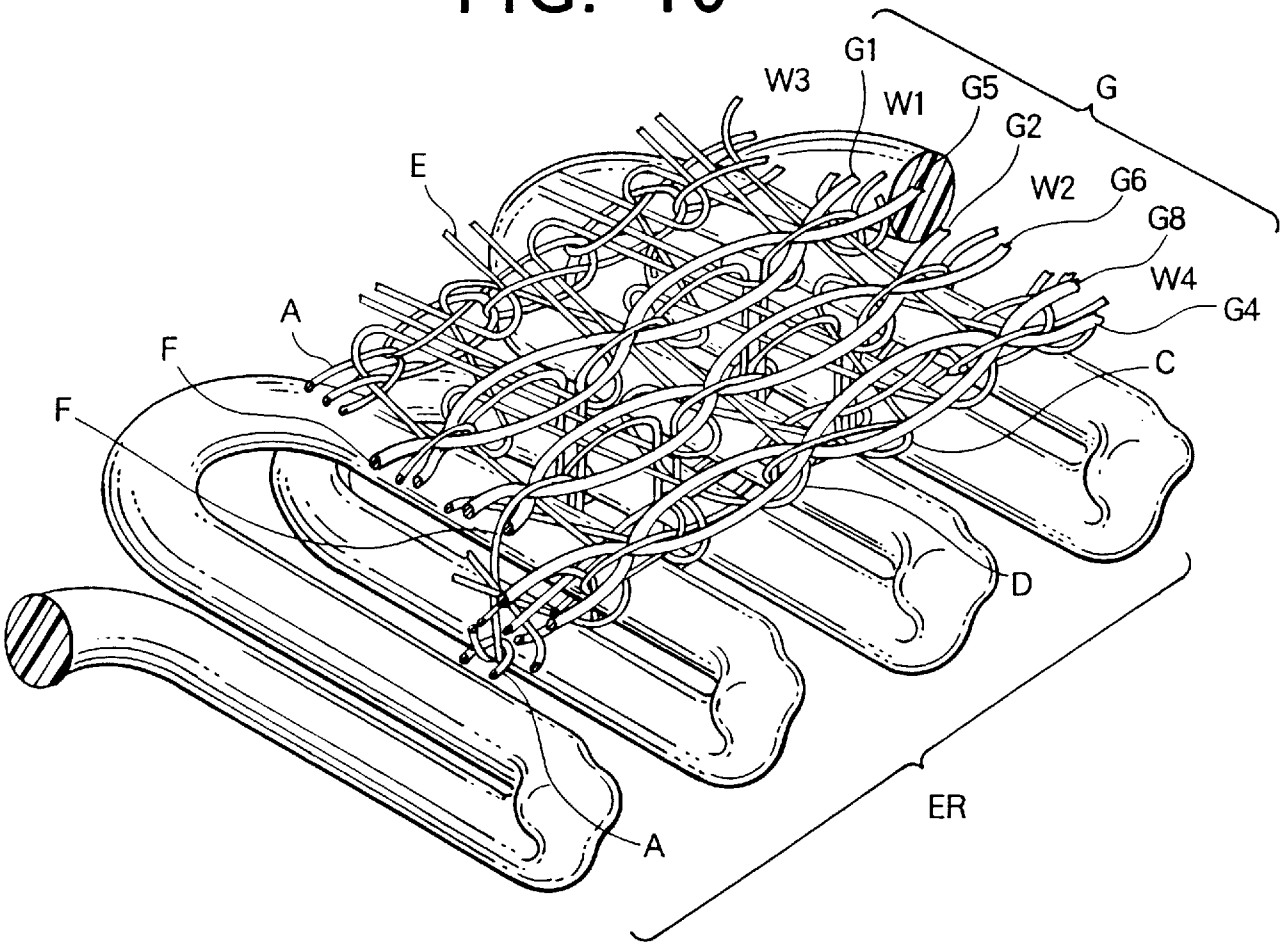
FIG. 10 is a fragmentary rear perspective view schematically showing an element-attaching marginal portion of a knit slide fastener stringer according to a seventh embodiment.

FIG. 10 shows a seventh embodiment in which two warp-inlaid yarns G1, G5; G2, G6 are inlaid warpwise one in the sinker loops of each of two anchoring chain stitch yarns F like the second embodiment but which is differentiated from the second embodiment in that the two warp-inlaid yarns G1, G5; G2, G6 are laid in and interlaced with every other sinker loops of a single wale W1, W2 in a symmetrical pattern, repeatedly crossing each other. Also two other warp-inlaid yarns G4, G8 are laid in the sinker loops of the chain stitch yarn A of the outermost wale W4; alternatively, the warp-inlaid yarns G to be laid in the sinker loops of the outermost chain stitch yarn A may be omitted, or two warp-inlaid yarns G3, G7 may be laid also in the sinker loops of the chain stitch yarn A, which is disposed adjacent to and at the inner side of the inner anchoring chain stitch yarn F.

This invention should by no means be limited to the foregoing embodiments, and various other modifications may be suggested. For example, the size of each of the knitting yarns of the ground structure in each of the foregoing embodiments may be selected as the case demands. Particularly the size of the warp-inlaid yarns G to be laid in the chain stitch yarn A nearest to the coupling heads of the fastener elements may be larger than that of the warp-inlaid yarns G to be laid in the inner anchoring chain stitch yarn F. This large-size warp-inlaid yarns G make the outer edge of the element-attaching marginal portion thick and heavy so that the coupled fastener element rows can be prevented at most from local split when an upward bending or thrusting stress acts on the slide fastener surface.

Also, the knitting pattern of each of the knitting yarns constituting the ground structure of the fastener tape T except the anchoring chain stitch yarns F should by no means be limited to the illustrated examples; for example, though the weft-inlaid yarns have three different knitting patterns in the illustrated examples, they may have a common knitting pattern.

Further, the anchoring chain stitch yarns F are laid in two wales in the foregoing embodiments. Alternatively they may be laid in three wales commensurate with the size of the fastener element row; in such event, at least a warp-inlaid yarn(s) G are laid in and interlaced with every anchoring chain stitch yarn F. Also, the continuous faster element row should by no means be limited to a coiled type and may be of a zigzag or meandering type as shown in FIG. 10, having successive U shapes, each of which constitutes upper leg portions of adjacent coupling elements and a turnover portion connecting the upper or lower leg portions together in a plane parallel to the general plane of the fastener tape T and which are arranged longitudinally alternately on the upper and lower sides of the coupling head portions provided therebetween.

Furthermore, this invention may be also applied to a concealed slide fastener stringer, in which firstly a continuous fastener element ER in the form of a coiled or meandering synthetic resin monofilament is attached to an element-attaching marginal portion of a fastener tape with coupling head portions disposed on the inner side remotely from the outer edge of the marginal portion and with turnover portions disposed on the outer side near the outer edge of the marginal portion and then the resulting stringer is attached to a garment with the marginal portion folded in such a manner that the coupling heads face to the outer side for mating with those of a companion slide fastener stringer.

According to the knit slide fastener stringer of this invention, partly since the individual fastener elements of a continuous fastener element row ER are secured at a number of positions by a number of the successive needle loops of each of the anchoring chain stitch yarns F, which constitute a number of wales in the element-attaching marginal portion EA, simultaneously with the knitting of the fastener tape T, each needle loop extending over the individual fastener element, and partly since the continuous fastener element row ER is supported on successive sinker loops, which constitute part of the ground structure of the element-attaching marginal portion EA and with which warp-inlaid yarns are interlaced in various forms, it is possible to give the ground structure of the element-attaching marginal portion EA a touch of woven cloth so that the fastener element row ER can be attached to the fastener tape T stably in size both warpwise and weftwise.

Consequently, with the fastener element row ER mounted on the ground structure of the element-attaching marginal portion EA, it is possible to avoid irregularity of the pitch, and knitting yarns disposed over and under the leg portions of the fastener elements are well balanced, so that the coupled fastener element rows ER can be adequately resistant against an upward bending stress which acts on the slide fastener surface, thus preventing local splitting due to raised coupled elements and guaranteeing the accurate closing and opening action of the slide fastener during use under any conditions.

Additionally, since the above-mentioned construction of this invention can be realized only by interlacing the warp-inlaid yarns G with the sinker loops of the chain stitch yarns A of the ground structure of the element-attaching marginal portion EA, it is possible to knit the fastener stringer without imparting excessive load on the knitting needles. And since the fastener stringer can be knitted on a single row of needle beds, it is possible to manufacture a conventional-problem-free knit slide fastener stringer in a simple process.

What is claimed is:

1. A knit slide fastener stringer comprising:

(a) a fastener tape knitted in a warp-knit ground structure and having along one longitudinal edge an element-attaching portion;

(b) a continuous fastener element row knitted in and along said element-attaching portion of said fastener tape and secured by two or more wales of anchoring chain stitch yarns simultaneously with the knitting of said fastener tape;

(c) successive needle loops of each of said two or more wales formed of said anchoring chain stitch yarns, which press said continuous fastener element row toward said warp-knit ground structure of said fastener tape from the upper side, and successive sinker loops, which constitute part of said ground structure; and (d) a number of warp-inlaid yarns each laid in and interlaced with at least part of said successive sinker loops.

2. A knit slide fastener stringer according to claim 1, wherein each of said warp-inlaid yarns is laid in and interlaced with said sinker loops along each of said wales in a zigzag pattern.

3. A knit slide fastener stringer according to claim 1, wherein a plurality of said warp-inlaid yarns are inlaid in and interlaced with said sinker loops along each of said wales individually in a zigzag pattern and collectively in a symmetrical pattern.

4. A knit slide fastener stringer according to claim 1, wherein a plurality of said warp-inlaid yarns are laid in and interlaced with said sinker loops of two or more of said wales individually in a zigzag pattern and collectively in a symmetrical pattern, extending across one another between said wales.

* * * * *